US006643876B2

(12) United States Patent
Visser et al.

(10) Patent No.: US 6,643,876 B2
(45) Date of Patent: Nov. 11, 2003

(54) NO-FLIP MATTRESS AND METHODS FOR THEIR CONSTRUCTION

(75) Inventors: Barney D. Visser, Denver, CO (US); Robert L. Rensink, Denver, CO (US)

(73) Assignee: Denver Mattress Co., LLC

( * ) Notice: Subject to any disclaimer, the term of this patent is extended or adjusted under 35 U.S.C. 154(b) by 0 days.

(21) Appl. No.: 09/989,003

(22) Filed: Nov. 21, 2001

(65) Prior Publication Data

US 2003/0093864 A1 May 22, 2003

(51) Int. Cl.[7] ..... A47C 27/05
(52) U.S. Cl. ..... 5/720; 5/716; 5/727
(58) Field of Search ..... 5/720, 727, 716, 5/655.8, 721, 690

(56) References Cited

U.S. PATENT DOCUMENTS 2,862,214 A * 12/1958 Thompson et al. ..... 5/720
3,869,739 A * 3/1975 Klein ..... 5/720
5,040,255 A * 8/1991 Barber, Jr. ..... 5/720
6,023,803 A * 2/2000 Barman ..... 5/716
6,243,900 B1 * 6/2001 Gladney et al. ..... 5/727
6,295,676 B1 * 10/2001 Warner ..... 5/720
6,408,469 B2 * 6/2002 Gladney et al. ..... 5/720
2002/0184712 A1 * 12/2002 Gladney et al. ..... 5/720

FOREIGN PATENT DOCUMENTS

DE 8809029.9 * 2/1989 ..... 5/727

* cited by examiner

*Primary Examiner*—Alexander Grosz
(74) *Attorney, Agent, or Firm*—Townsend and Townsend and Crew LLP

(57) ABSTRACT

A mattress comprises a core of springs having a fabric covering, such as fabric pockets. A top padding layer is positioned on top of the core, and a bottom support layer is disposed below the core. The bottom support layer is bonded to the fabric covering to couple the bottom support layer to the core.

23 Claims, 3 Drawing Sheets

NO-FLIP MATTRESS AND METHODS FOR THEIR CONSTRUCTION

BACKGROUND OF THE INVENTION

This invention relates generally to the field of mattresses, and in particular to so called one-sided or no-flip mattresses. More specifically, the invention relates to such mattresses that are constructed using an inner core of springs.

Spring mattresses have been in use for over 100 years. Existing spring mattresses use a variety of spring types to form their inner core. Perhaps the most common is the traditional wire spring assembly having a set of interconnected wire spring coils. As is well known in the art, a major supplier of such springs is Leggette & Platt.

Another type of spring assembly is the so-called Marshall construction that was developed in the late 1890's by Marshall Mattress of Toronto, Canada. The Marshall design utilizes fabric pockets to encapsulate each spring. In this way, the coils may flex separately from each other. Examples of such pocket coil spring designs are described in, for example, U.S. Pat. Nos. 685,160; 4,234,983; 4,854,023; 6,029,957; and 6,295,676 and published PCT No. WO99/32396, among others. The complete disclosures of all these references are herein incorporated by reference.

Traditional mattresses have a padding layer disposed both on top of and beneath the core of springs. This is encased within a fabric or ticking, and may optionally include additional layers of padding to form a "pillow top" mattress as is known in the art. Because of potential uneven wear during the life of the mattress, many manufacturers recommend periodically rotating or flipping the mattress. However, because this can be difficult and inconvenient, many users do not follow this practice. For those that do, this exercise can be annoying.

As a result, the one-sided or no-flip mattress has been developed. Several manufacturers have developed and sold such mattresses at least as early as the mid 1990s. For instance, Sleep Therapy mattresses have been sold by Wickline Bedding Co., San Diego, Calif. since the early 1990s. These mattresses have a polyurethane foam layer underneath the springs and a traditional padding layer on top. This design was subsequently adopted by Simmons Company as demonstrated by their U.S. Pat. No. 6,243,900, the complete disclosure of which is herein incorporated by reference.

This invention is related to improved methods for manufacturing so called one-sided or no-flip mattresses. As described hereinafter, such mattresses provide increased firmness, stability and comfort, among other features. Further, such mattresses may be economically produced to provide a commercially attractive mattress.

BRIEF SUMMARY OF THE INVENTION

The invention provides exemplary mattresses as well as methods for their construction. In one embodiment, a mattress comprises a core of springs having a fabric covering. For example, the springs may be individually encased in fabric pockets. A top padding layer is positioned on top of the core of springs, and a bottom support layer is disposed below the core of springs. The bottom support layer is bonded to the fabric covering of the core to couple the bottom support layer to the core of springs. Such a construction is particularly useful where at least some of the fabric pockets are pre-joined to each other near midpoints of the coils so that independent movement of both the tops and bottoms of the coils is permitted. By bonding the bottom support layer to the fabric covering, additional stability is provided to the mattress by limiting the lateral movement of the bottoms of the springs relative to each other while still permitting individual movement of the tops of the springs relative to each other.

Another feature of such mattresses is that the bottom support layer may be constructed of a matrix of foam elements, such as a rebond material. Such materials are relatively dense, have good firmness, and are still cost effective. For example, the bottom support layer may have a density of about 3 pounds per cubic foot or greater, with one particularly useful density being about 3.5 to about 4.5 pounds per cubic foot. The firmness of the bottom support layer may be measured in terms of its mean indentation force deflection (IFD) that may be in the range from about 40 to about 80, and more preferably from about 50 to about 70. Further, the bottom support layer may have a thickness in the range from about 0.5 inches to about 3 inches and may be formed from one or more stacked pieces.

In one aspect, a border element, such as a border wire, may be coupled to a perimeter of the core of springs. For example, the border wire may be clipped to the individual coils with rings. In some cases, a border wire may not be included. In one alternative, a foam encasement may be used to replace one or more of the outside rows of springs so that a border wire is not needed.

In another aspect, a quilted material may be placed over the top layer, and a border material may be secured about the sides of the mattress. A cover material may also be placed over the bottom support layer.

To manufacture such a mattress, the bottom support layer is bonded to the fabric pockets using a bonding material, such as glue. The top padding layer is placed on top of the core of springs and a quilted or other material is placed over the core and top and bottom layers.

DESCRIPTION OF THE SPECIFIC EMBODIMENTS

The invention provides exemplary no-flip mattresses and methods for their construction. Such mattresses may be constructed using springs that are encased in fabric. The springs may be individually encased in fabric, or groups of springs may be encased. Although useful with any core of springs that are encased in fabric, the mattresses of the invention will achieve particular advantages when constructed of pocket coil springs that are able to move independently from one another. For example, the mattresses may be constructed of pocket coil springs that are formed as strings, with the strings being coupled to each other near midpoints of adjacent springs. The strings may be coupled to each other by using thermal welds or a continuous line of glue passing along the strings, among others. Such spring assemblies are constructed so that individual springs can compress independent of each other to provide comfort to the user. Examples of such spring assemblies are described in PCT Publication No. WO99/32963 and U.S. Pat. Nos.

6,029,957 and 4,578,834, among others. These disclosures are herein incorporated by reference.

According to the invention, a bottom support layer is bonded directly to the fabric encasing the springs. This prevents lateral movement of the bottoms of the springs relative to each other and provides stability to the core of springs. At the same time, at least some or all of the top ends of the springs remain unattached to each other and therefore may move independent of each other. In this way, the mattress has both stability and comfort, and particularly more stability than that provided when only using a border rod to hold the springs together.

Another feature of the mattresses of the invention is that they may utilize a relatively dense bottom support layer to provide the mattress with increased durability. For example, the bottom support layer may have a density that is about 3 pounds per cubic foot or greater, more preferably from about 3 to about 8 pounds per cubit foot, and most preferably from about 3.5 to about 4.5 pounds per cubic foot. One particularly effective material is a matrix of foam pieces, known as rebond. This material is firm and is constructed of a variety of small urethane or other foam pieces (typically reclaimed) that are joined together using an adhesive, heat and steam that tend to increase the density. Such a material is relatively dense, has an IFD in the range from about 40 to about 80 and is relative inexpensive. The IFD may vary depending on the IFDs of the individual pieces and may vary throughout the support layer. As such, the IFD may conveniently be defined in terms of a mean or average IFD. By using such a material, the mattress may have a durable construction while being relatively inexpensive. Other types of materials that may be used include polystyrene materials.

Figure 1:
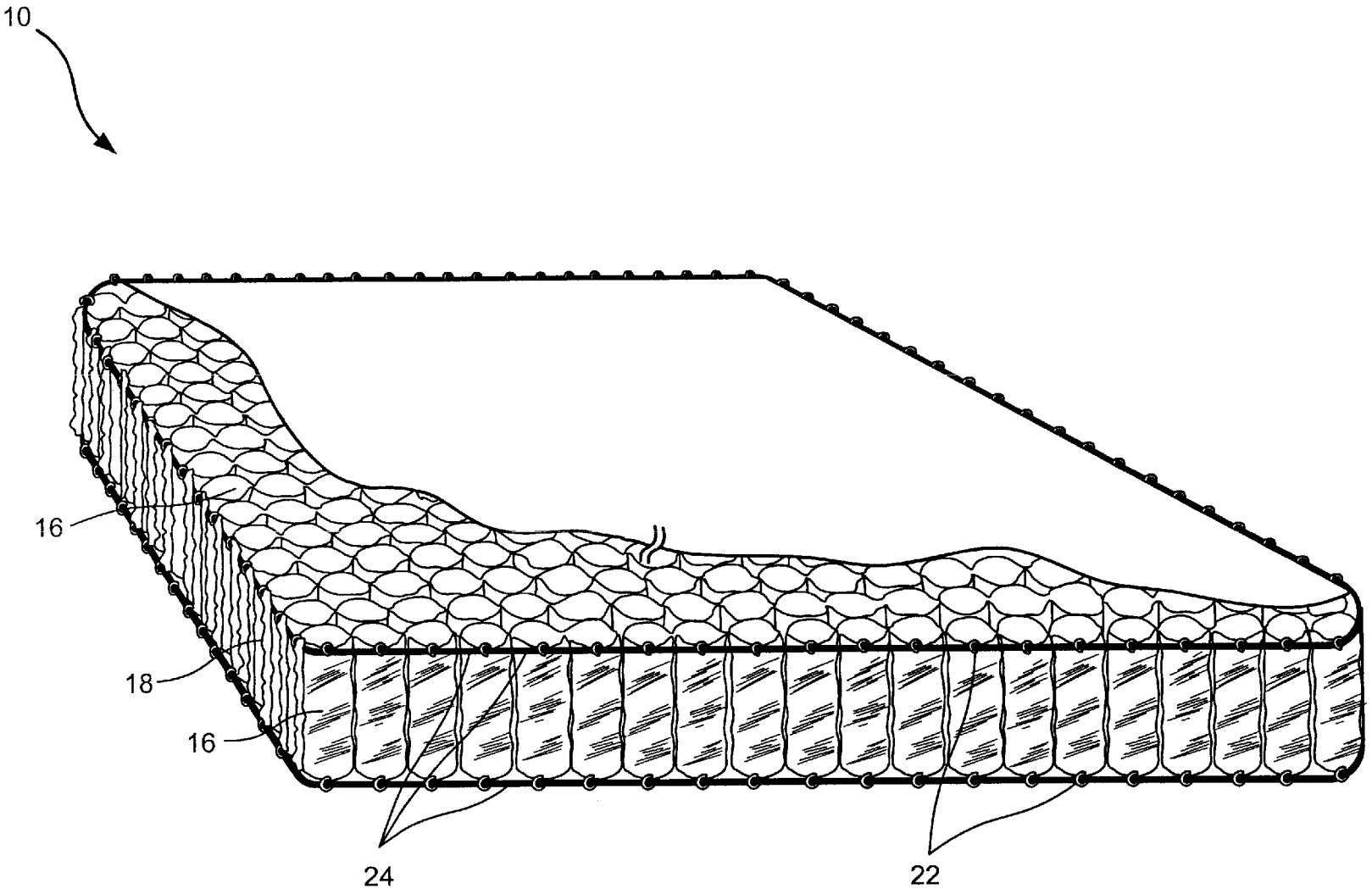
FIG. 1 is a top perspective view of a core of individually pocketed springs to which are coupled a pair of border wires.
Figure 2:
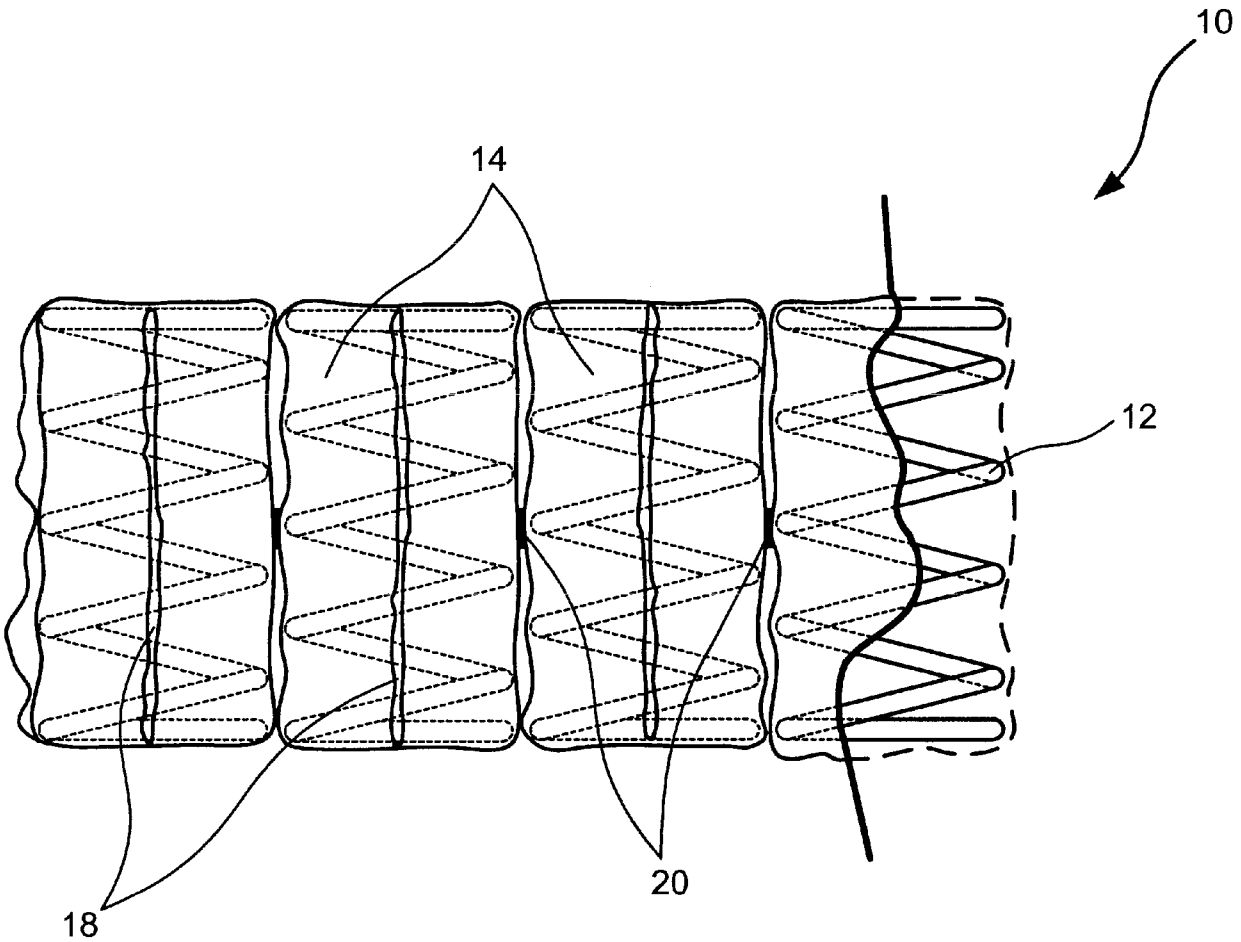
FIG. 2 is a side view of a section of pocketed springs of the core of FIG. 1.

Referring now to FIGS. 1 and 2, one embodiment of a core 10 of springs 12 will be described. Core 10 may be used as part of a no-flip mattress as described hereinafter with reference to FIG. 3. However, the invention is not intended to be limited only to mattresses using such cores. For example, other cores that may be used include those having open coil springs, latex cores, and the like. Core 10 is constructed of a plurality of fabric pockets 14 into which springs 12 are disposed. As will be appreciated, a variety of techniques may be used to form pockets 14, to place springs 12 into pockets 14 and to secure pockets 14 together. For example, techniques that may be used to form core 10 are set forth in the patents and publications previously incorporated by reference.

As shown in FIGS. 1 and 2, core 10 is constructed of multiple strings 16 of fabric pockets 14 that include springs 12. Each string 16 may be formed from a single sheet of fabric that is sewn or welded together at seams 18 to form pockets 14. Strings 16 are joined to each other near midpoints 20 as shown in FIG. 2. This may be a continuous glue line, an internal weld, or the like. Such a configuration permits independent movement of adjacent springs 12 to enhance the degree of comfort provided by core 10.

Secured about a perimeter of core 10 are border rods 22. A set of rings 24 are used to clip border rods 22 to individual springs 12 as shown in FIG. 1. Border rods 22 help stabilize the outer edges of core 10 by holding the outer springs together.

Figure 3:
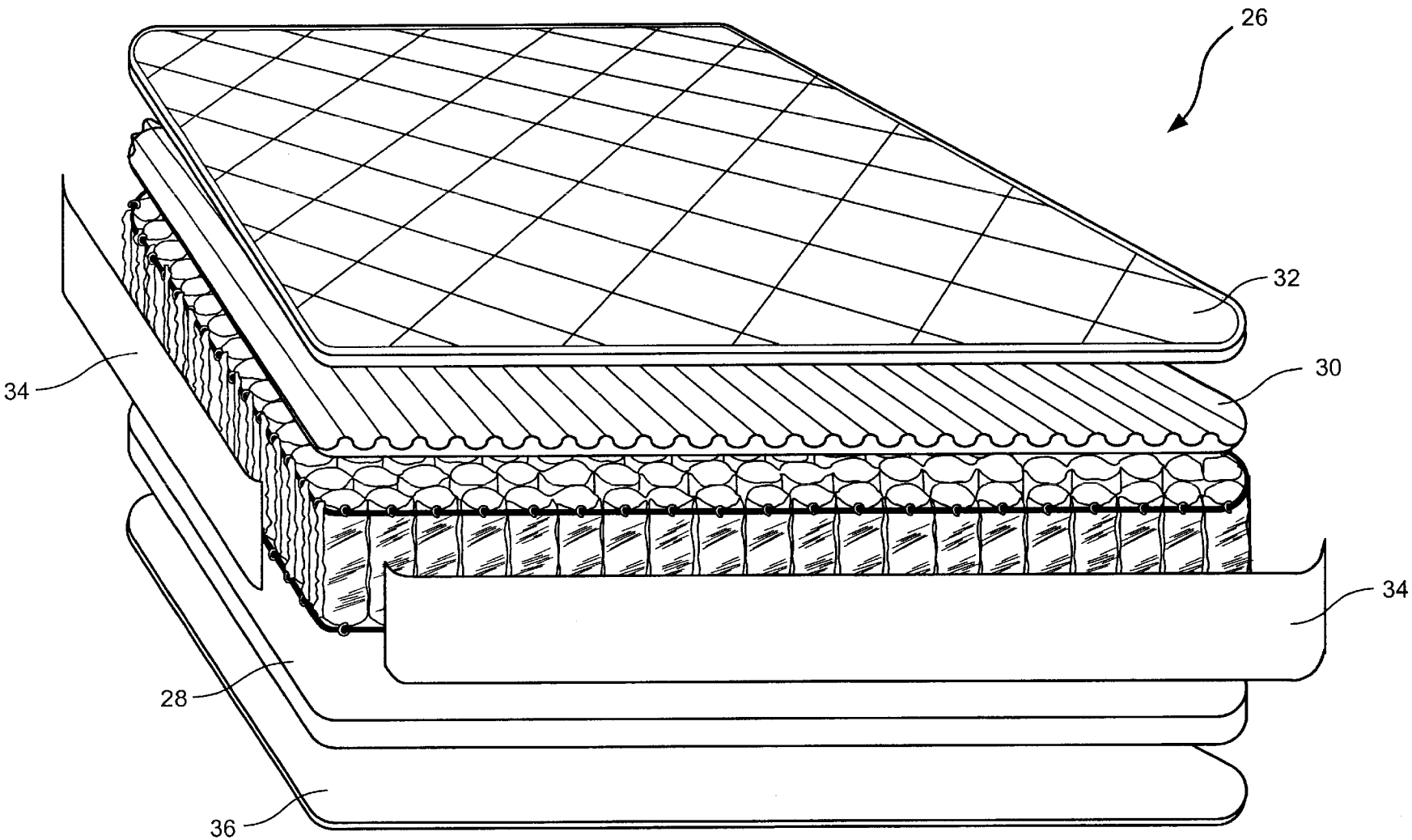
FIG. 3 is an exploded view of a mattress having the core of springs of FIG. 1 according to the invention.

Shown in FIG. 3 is a mattress 26 that includes core 10. Mattress 26 is configured as a no-flip or one-sided mattress by utilizing a bottom support layer 28 that is intended to remain underneath core 10 (on the non-sleeping surface). One feature of support layer 28 is that it is bonded to core 10, and in particular to the fabric pockets 14. This holds the bottoms of springs 12 together to prevent or substantially reduce their lateral movement. In this way, mattress 16 has greater stability while still maintaining comfort by permitting the tops of springs 12 to move independent of one another. Another advantage is that border rods 22 are not needed to couple support layer 28 to core 10, and in some cases may be eliminated altogether, at least on the bottom of the mattress.

Support layer 28 may be bonded to pockets 14 using a bonding material such as a hot melt glue, a latex glue or the like. In some cases, a layer of non-woven fabric may be placed between core 10 and support layer 28. In such a case, the fabric may be attached or glued to the support layer 28, and the fabric may then be secured to core 10, such as by the use of hog rings that are coupled to the springs. In this way, glue does not need to contact core 10. Pockets 14 may be constructed of a material such as Duon™, Versare™ or a non-woven fabric to facilitate bonding. To bond support layer 28 to core 10, the bonding material may be deposited onto support layer 28 and/or to pockets 14 and the two placed adjacent to each other. This may be done on a conveyor to reduce manufacturing times.

Support layer 28 may be constructed of a relatively dense material to increase the durability of mattress 26. For example, support layer 28 may have a density greater than about 3 pounds per cubic foot. One exemplary material is rebond (a carpet padding material) and may have a thickness of about 0.5 inches to about 3 inches. Such a material is relatively inexpensive to reduce the cost of mattress 26. Such a material is also relatively stiff, having a stiffness of about 40 IFD to about 80 IFD, and more preferably from about 50 IFD to about 70 IFD.

Disposed on top of core 10 is a top padding layer 30 and may be constructed of a material such as a polyurethane or latex foam, a visco-elastic or memory foam material, or the like. Top padding layer may simply rest on core 10 to permit independent movement of springs 12.

Positioned on top of layer 30 is a quilted layer 32 that provides additional padding to the user and serves as the sleeping surface for mattress 26. Sewn to layer 32 are sides 34, and sewn to sides 34 is a bottom cover 36. Sides 34 and bottom cover 36 are constructed of conventional fabrics and protect the interior components of mattress 36 as well as providing an aesthetically pleasing surface.

Mattress 36 is constructed such that the top surface formed by layer 32 is the only sleeping surface. In this way, mattress 36 does not need to be periodically flipped to the other side. Further, by using a dense bottom support layer, mattress 36 has a durable construction to provide increase life. Mattress 36 also has improved stability by stabilizing the bottoms of the springs.

The invention has now been described in detail for purposes of clarity and understanding. However, it will be appreciated that certain changes and modifications may be practiced within the scope of the appended claims.

What is claimed is:

1. A mattress comprising:

a core of springs having a fabric covering, wherein to springs each have a top end and a bottom end;

a top padding layer positioned on top of the core of springs; and a bottom support layer beneath the core of springs, wherein the bottom support layer is bonded to to fabric covering of the core to couple the bottom support layer to the bottom end of the core of springs, wherein the top padding layer is unbonded to the core of springs to permit individual movement of the top ends of the springs relative to each other, and wherein the bottom support layer has a firmness that is at least about 40 IFD.

2. A mattress as in claim 1, wherein the fabric covering comprises individual fabric pockets encasing each spring.

3. A mattress as in claim 2, wherein the fabric pockets are disposed in rows, and wherein adjacent rows of the fabric pockets are connected to each other near midpoints of each of the pockets.

4. A mattress as in claim 1, wherein the bottom support layer comprises a matrix of foam elements.

5. A mattress as in claim 4, wherein the bottom svpport layer comprises rebond.

6. A mattress as in claim 4, wherein the bottom support layer has a thickness in the range from about 0.5 inches to about 3 inches.

7. A mattress as in claim 1, wherein the bottom support layer has a density greater than about 3 pounds per cubic foot.

8. A mattress as in claim 7, wherein the bottom support layer has a density of about 4 pounds per cubic foot.

9. A mattress as in claim 1, further comprising a border element coupled to a perimeter of the core of springs.

10. A mattress as in claim 9, wherein the border element comprises a rod that is coupled to the core of springs with rings.

11. A mattress as in claim 1, further comprising a quilted material disposed on top of the top layer.

12. A mattress as in claim 1, further comprising a border material disposed around sides of the core of springs.

13. A mattress as in claim 1, further comprising a cover material disposed over the bottom support layer.

14. A method for constructing a mattress, the method comprising:

providing a core of springs that are encased in fabric pockets;

placing a top padding layer on top of the core of springs;

bonding a bottom support layer to the fabric pockets to couple the bottom support layer to the core of springs and to restrict movement of the springs relative to each other near the bottom support layer to stabilize the mattress, wherein the bottom support layer has firmness that is at least about 40 IFD.

wherein the bonding step comprising applying adhesive to the bottom support layer and placing the bottom support layer against the fabric pockets, and wherein no adhesive is applied between the top padding layer and the core of springs.

15. A method as in claim 14, wherein the fabric pockets are disposed in rows, and wherein adjacent rows of the fabric pockets are connected to each other near midpoints of each of the pockets.

16. A method as in claim 14, wherein the bottom support layer comprises rebond that is constructed of a matrix of foam elements, and wherein the rebond has a density of about 3 pounds per cubic foot or greater.

17. A method as in claim 14, wherein the bottom layer has a density of about 4 pounds per cubic foot.

18. A method as in claim 14, further comprising coupling a border element to a perimeter of the core of springs.

19. A method as in claim 18, wherein the border element comprises a rod, and further comprising coupling the rod to the core of springs with rings.

20. A method as in claim 14, further comprising placing a quilted material of the top layer.

21. A method as in claim 14, further comprising placing a border material around the sides of the core of springs.

22. A method as in claim 14, further comprising placing a cover material over the bottom support layer.

23. A mattress comprising;

a core of springs having a fabric covering, wherein the springs each have a top end and a bottom end;

a top padding layer positioned on top of the core of springs; and a bottom support layer beneath the core of springs, wherein the bottom support layer is bonded to the fabric covering of the core to couple to bottom support layer to the core of springs, wherein the top padding layer is unbonded to the core of springs to permit individual movement of the top ends of the springs relative to each other, and wherein the bottom support layer comprises a matrix of foam elements having a density of about 3 pounds per cubic foot or greater, and wherein the bottom layer has a firmness of at least about 40 IFD.

* * * * *